US006713970B2

(12) United States Patent
Bancal

(10) Patent No.: US 6,713,970 B2
(45) Date of Patent: Mar. 30, 2004

(54) FLAT DISPLAY SCREEN WITH AN ADDRESSING MEMORY

(75) Inventor: Bernard Bancal, Meyreuil (FR)

(73) Assignee: Pixtech S.A., Rousset (FR)

( * ) Notice: Subject to any disclaimer, the term of this patent is extended or adjusted under 35 U.S.C. 154(b) by 0 days.

(21) Appl. No.: 09/858,813

(22) Filed: May 16, 2001

(65) Prior Publication Data

US 2002/0011797 A1 Jan. 31, 2002

(30) Foreign Application Priority Data

May 30, 2000 (FR) ..... 00 06921

(51) Int. Cl.[7] ..... G09G 3/10
(52) U.S. Cl. ..... 315/169.1; 313/309; 313/499
(58) Field of Search ..... 315/169.4, 169.1, 315/169.3; 313/309, 351, 498, 499, 500, 506, 310

(56) References Cited

U.S. PATENT DOCUMENTS 4,940,916 A 7/1990 Borel et al. ..... 313/306
5,313,140 A 5/1994 Smith et al. ..... 315/169.1
5,347,201 A * 9/1994 Liang et al. ..... 313/309
5,404,074 A 4/1995 Watanabe et al. ..... 313/495
5,537,007 A 7/1996 Harberts et al. ..... 315/169.1
5,808,403 A 9/1998 Clerc ..... 313/336
5,814,924 A 9/1998 Komatsu ..... 313/309
5,834,883 A 11/1998 Bruni et al. ..... 313/309
5,847,408 A 12/1998 Kanemaru et al. ..... 257/10
5,945,968 A 8/1999 Hush ..... 345/74
6,172,455 B1 * 1/2001 Bancal et al. ..... 313/309

FOREIGN PATENT DOCUMENTS

EP 0 589 523 A1 3/1994

* cited by examiner

*Primary Examiner*—Don Wong
*Assistant Examiner*—Thuy Vinh Tran
(74) *Attorney, Agent, or Firm*—Duane Morris LLP

(57) ABSTRACT

A cathode-grid plate of a field-effect flat display screen of the type including a first set of row conductors, a second set of column conductors and, for each screen pixel, defined by the intersection of a column and of a line, an element for temporarily storing the luminance control signal of the considered pixel.

8 Claims, 5 Drawing Sheets

FLAT DISPLAY SCREEN WITH AN ADDRESSING MEMORY

BACKGROUND OF THE INVENTION

1. Field of the Invention

The present invention relates to the field of flat display screens, and more specifically to so-called cathodoluminescent screens, an anode of which supports phosphor elements likely to be excited by electron bombarding. The present invention more specifically applies to screens of field-effect type, in which the electron bombarding canes from microtips supported by a screen cathode.

2. Discussion of the Related Art

FIG. 1 shows an example of a conventional structure of a flat color microtip screen of the type to which the present invention relates. Such a screen is essentially formed of a cathode 1 with microtips 2 and of a grid 3 provided with holes 4 corresponding to the locations of the microtips. Cathode 1 is placed opposite to a cathodoluminescent anode 5, a substrate 6 of which, for example, made of glass, generally forms the screen surface.

The operating principle and a specific embodiment of a microtip screen are described, for example, in U.S. Pat. No. 4,940,916 of the Commissariat à 1 ' Energie Atomique.

Cathode 1 is generally arranged in columns and is formed, on a substrate 10, for example, made of glass, of cathode conductors arranged in meshes from a conductive layer. Microtips 2 are generally made on a resistive layer 11 deposited on the cathode conductors and are arranged within the meshes defined by the cathode conductors. FIG. 1 partially shows the inside of a mesh, without showing the cathode conductors. Cathode 1 is associated with grid 3, comprising row conductors. Gate 3 is deposited on the cathode plate with an interposed insulating layer 12. The intersection of a grid row and of a cathode column generally defines a pixel.

This device uses the electric field created between cathode 1 and grid 3 to extract electrons from microtips 2. The electrons are then attracted by phosphor elements 7 of anode 5, if said elements are properly biased. In the case of a color screen such as illustrated in FIG. 1, anode 5 is, for example, provided with alternate strips of phosphor elements 7*r*, 7*g*, 7*b*, corresponding to each of the colors (Red, Green, Blue). The strips may be separated from one another by an insulator 8. The phosphor elements are deposited on electrodes 9, for example, formed of corresponding strips of a conductive layer (transparent if the anode forms the screen surface), for example, indium and tin oxide (ITO). The sets of red, green, blue strips are for example alternately biased with respect to cathode 1, so that the electrons extracted from the microtips 2 of a pixel of the cathode/grid are alternately directed to the phosphor elements 7 facing each of the colors.

In the case, not shown, of a monochrome screen, the anode supports phosphor elements of same color arranged in a single plane or in two sets of separately-biased alternate strips.

Other cathode-grid and anode structures than those described hereabove may be encountered. For example, the phosphor elements of the anode may be distributed in elementary patterns corresponding to the sizes of the screen pixels. The anode may further, while being formed of several sets of strips or of elementary patterns of phosphor elements, not be switched by sets of strips or patterns. All the strips or patterns then are at a same voltage, for example, by being supported by a conductive plane. The anode is then said to be "unswitched", as opposed to switched anodes where the colors are alternately biased.

The anode strips or patterns supporting phosphor elements to be excited are biased under a voltage of several hundreds, or even a few thousands, of volts with respect to the cathode. In the case of a switched anode screen having several sets of strips, the other strips are at a zero voltage. The choice of the values of the biasing voltages is linked to the characteristics of the phosphor elements and of the emissive means on the cathode side.

For an electron emission by the cathode microtips, said cathode must be submitted, with respect to grid 3, to a sufficient potential difference. Conventionally, under a potential difference on the order of 50 V between the cathode and the grid, there is no electron emission, and the maximum emission used corresponds to a potential difference on the order of 80 V. For example, the rows of grid 3 are sequentially biased to a voltage on the order of 80 V while the columns of cathode 1 are brought to respective voltages ranging between a maximum emission voltage and a no emission voltage (for example, respectively 0 and approximately 40 V). The brightness of all pixels in a row is thus determined (per color component if the anode includes several sets of strips selectively biased color per color).

FIG. 2 shows the equivalent electric diagram of a conventional pixel of a color microtip screen. It is arbitrarily assumed to be a pixel, but it should be noted that this same equivalent electric diagram corresponds to that of each emissive microtip. However, since the microtips are several thousands per screen pixel, the present description is simplified by referring to a pixel (or to a sub-pixel in the case where the grid rows are divided up per color).

The pixel microtips electrically form a current source 20, a first terminal 21 of which is connected, via a resistor 22 symbolizing the resistive layer (11, FIG. 1), to a terminal 23 of application of cathode voltage V1. The other terminal 24 of current source 20 corresponds to the tips of microtips 2 directed towards the anode symbolized by a plate 25 to which is applied a biasing voltage V5. The insulator (12, FIG. 1) between the grid and the cathode can be modeled by a capacitor 26 connecting terminal 21 of current source 20 to a grid row 28, and thus to a terminal 27 of application of a biasing voltage V3 of the grid row. Due to the holes (4, FIG. 1) made in the grid, grid row 28 is connected directly connected to the tip (current source 20).

FIGS. 3A and 3B schematically illustrate the meshing of the cathode conductors of a conventional microtip screen. FIG. 3A partially shows in top view a cathode plate of a flat screen, that is, a microtip cathode associated with a grid, and FIG. 3B is a cross-section view along line B–B' of FIG. 3A. For clarity, the limits between the different layers have been shown in top view, in a shifted way in FIG. 3A, to be made visible. It should however be noted that, except for the microtips, the edges of the different layers can be considered as being substantially vertical, their inclination being essentially due to the used deposition and etch techniques, the manufacturing of microtip screens using techniques currently used in integrated circuit manufacturing.

Several microtips 2, for example, sixteen, are arranged in each mesh 31 defined by cathode conductors 32. Although a reduced number of meshes has been shown for each pixel 33 defined by the intersection of a column 34 of cathode 1 with a line 35 of grid 3, it should be noted that the microtips are generally several thousands per screen pixel.

Cathode 1 is generally formed of layers successively deposited on substrate 10. A conductive layer, for example, formed of niobium, is deposited on substrate 10. This layer is etched according to the pattern of columns 34, each column comprising meshes 31 surrounded with cathode conductors 32. A resistive layer 11 is then deposited on cathode conductors 32. Resistive layer 11, formed, for example, of phosphorus-doped amorphous silicon, has the purpose of protecting each microtip 2 against an excess current upon its starting. Such a resistive layer 11 aims at homogenizing the electron emission of the microtips 2 of a pixel of cathode 1 and thus at increasing its lifetime. The resistive layer may be etched according to the column pattern and/or at least partially opened above the cathode conductors. An insulating layer 12, for example, made of silicon oxide ($SiO_2$), is deposited on resistive layer 11 to insulate cathode conductors 32 from grid 3. A microtip cathode of this type is described, for example, in European patent application No. 0,696,045.

Cathode conductors 32 may be deposited on resistive layer 11 which may, as in the preceding case, be or not a full plate layer. A microtip cathode of this type is described, for example, in French patent application No. 2,722,913.

Grid 3 is, for example, formed from a niobium conductive layer, deposited on insulating layer 12. It is etched according to the pattern of lines 35 and is opened, like insulating layer 12, to form holes 4 above each microtip 2.

The conventional addressing of the cathode and of the grid of a flat microtip screen results in that each line of grid 3 is only addressed for a short time. For example, the grid lines are sequentially biased during a "line time" during which each column 34 of cathode 1 is brought to a voltage which is a function of the brightness of the pixel to be displayed along the current line. The biasing of the cathode columns changes for each new line. A "line time" corresponds to the duration of a frame divided by the number of lines of grid 3. The display of an image is performed during an "image time"(for example, 20 milliseconds for a 50 Hz frequency). For a color screen with a switched anode, a "frame time" approximately corresponds to one third of the "image time" decreased by the time required by possible anode switchings.

The conventional addressing of such a display screen causes brightness problems which are permanently attempted to be improved. The screen brightness depends on several factors, among which the anode bias voltage with respect to the cathode, the peak emission current of the microtips, the light efficiency of the phosphor elements, the emission surface area of a pixel, and the emission duration.

The anode-cathode voltage essentially depends on the height of the inter-electrode space. The emission current depends on the characteristics of the microtips, and the light efficiency depends on the phosphor elements and may vary under the influence of the electron bombarding. The emission surface area depends on the definition desired for the screen, that is, on the pixel surface. As for the emission duration, it depends on the line time, that is, on the duration during which each line is addressed in the scanning.

In such a screen, advantage is taken of the remanence of human eye to use only a small duty cycle (duration of a line addressing with respect to the frame duration).

It has already been suggested to lengthen the emission duration of the tips of a pixel of the cathode-grid without adversely affecting the screen control capacity in a row or column scanning system.

For example U.S. Pat. Nos. 5,313,140 and 5,537,007 provide, in the cathode-grid plate, temporary storing elements to hold the luminance control signal during a time period longer than the addressing time of a pixel.

FIG. 4 shows an equivalent electric diagram of a microtip screen pixel provided with such a storing element. FIG. 4 should be compared with previously-described FIG. 2. Such a pixel may further be modeled as a current source 20 representing the pixel microtips and having a first terminal 21 connected to a grid line 28 via a capacitor 26 representing the capacitance of the insulator (12, FIGS. 1 and 3B) between the cathode and the grid. A second terminal 24 of current source 20 represents the tip of the microtip directed towards anode 25. Terminal 21 of source 20 is connected, via a resistor 22 symbolizing the resistive layer (11, FIGS. 1 and 3B) to a first terminal of a switch 40, a second terminal of which is connected to a terminal 23 for addressing the considered column.

Without modifying the principle of addressing by scanning the rows and applying a luminance control signal on the screen columns, it can be seen that the embodiment of FIG. 4 still suffers from a pollution of the power stored in capacitor 26 by the emission current.

To avoid for the storage of the luminance control signal to be disturbed by the electron emission, the luminance information is stored from the screen grid and not from its cathode.

SUMMARY OF THE INVENTION

An object of the present invention is to provide a new solution for improving the amount of electrons emitted by the microtips of a screen pixel during each frame time.

The present invention also aims at providing a solution which does not require increase of the emission surface area and thus maintains, or even improves, the screen resolution.

The present invention further aims at providing a solution which does not require modifying the microtip emission current and thus keeps conventional microtip manufacturing methods.

More specifically, the present invention provides, for each screen pixel, a transistor for isolating an element for temporarily storing the luminance control signal of the considered pixel, outside of an addressing period of this pixel, the control gate oxide of each transistor being formed in an insulating layer separating the cathode conductors from the grid conductors of the emissive areas.

According to an embodiment of the present invention, each transistor is a depletion transistor including a first contact in a same conductive level as the microtip biasing conductors, and a second contact in a conductive level in which are formed extraction grid regions, corresponding to each pixel.

According to an embodiment of the present invention, the depletion area of each transistor is formed in a semiconductor level constitutive of a resistive layer for biasing the microtips.

According to an embodiment of the present invention, the microtips are connected to a fixed voltage, the luminance control signal being applied on the extraction grid.

The present invention also provides a flat display screen of the type including a cathode with microtips for bombarding a cathodoluminescent anode, the capacitance of the storage elements associated with each pixel being a function of the number of screen lines and of the voltage between the anode and the cathode.

The present invention also provides a method for controlling a flat display screen consisting of performing a row scanning for successively biasing the row conductors and, for each row, applying a luminance control signal on each column conductor.

According to an embodiment of the present invention, the method consists of discharging all storage elements of the screen between two display frames.

The foregoing objects, features and advantages of the present invention will be discussed in detail in the following non-limiting description of specific embodiments, in conjunction with the accompanying drawings.

DETAILED DESCRIPTION

Figure 1:
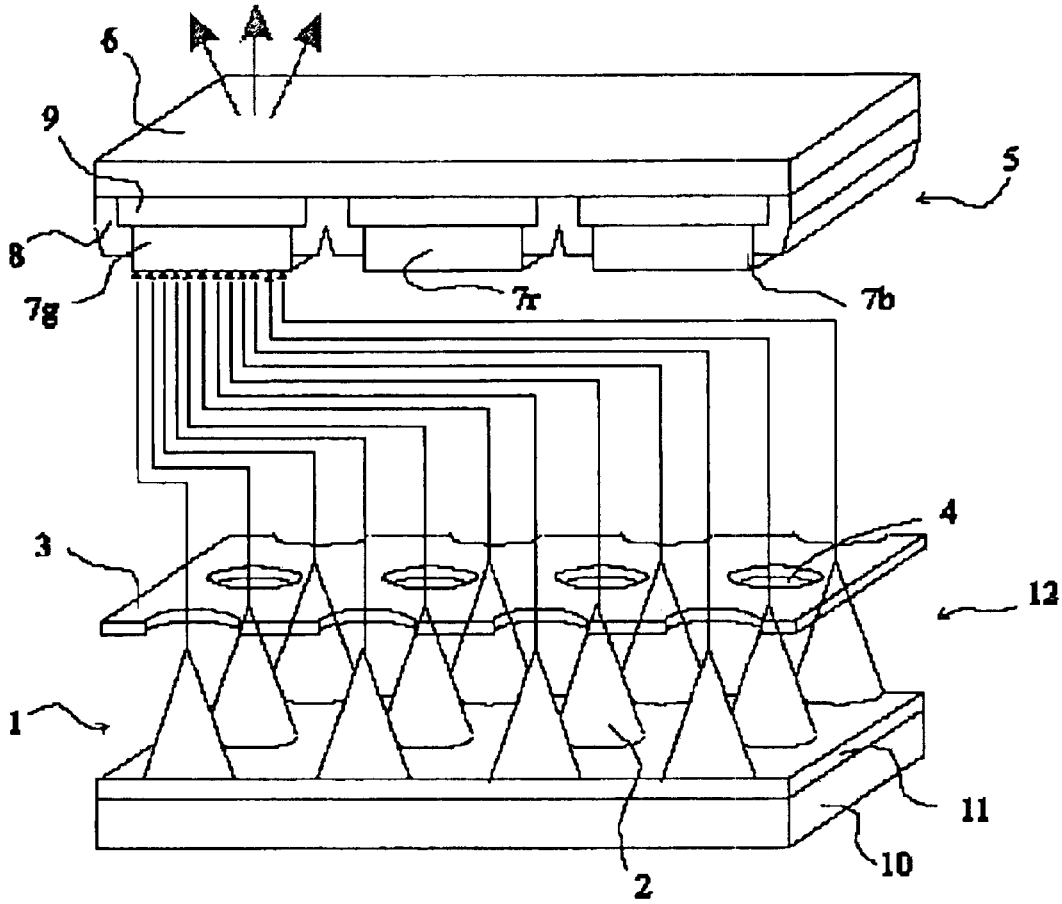
Fig 1 (Prior Art)
FIG. 1 is a simplified partial perspective view of a conventional flat microtip screen.
Figure 2:
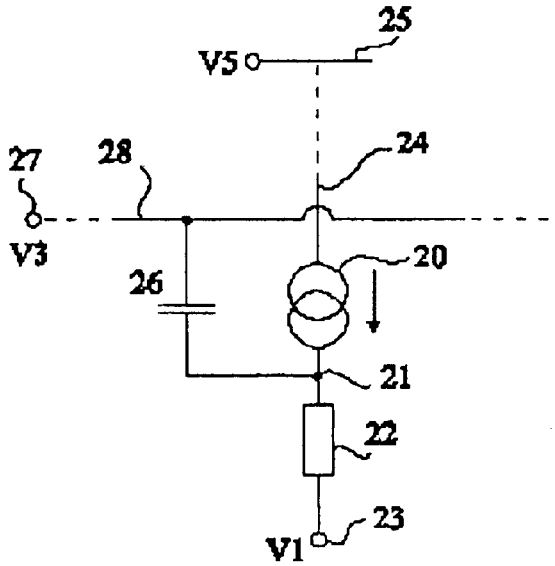
Fig 2 (Prior Art)
FIG. 2 shows an equivalent electric diagram of a pixel of a conventional microtip screen.

The same elements have been referred to with the same references in the different drawings. For clarity, only those elements necessary to the understanding of the present invention have been shown in the drawings and will be described hereafter. In particular, it should be noted that a flat display screen is associated with an external control circuit intended for biasing the rows and columns of the cathode-grid as well as the anode conductors. This control circuit uses conventional electronic circuit techniques and will not be detailed, its structure and operation being within the abilities of those skilled in the art based on the functional indications given hereafter and on the operation desired for the screen.

Figure 5:
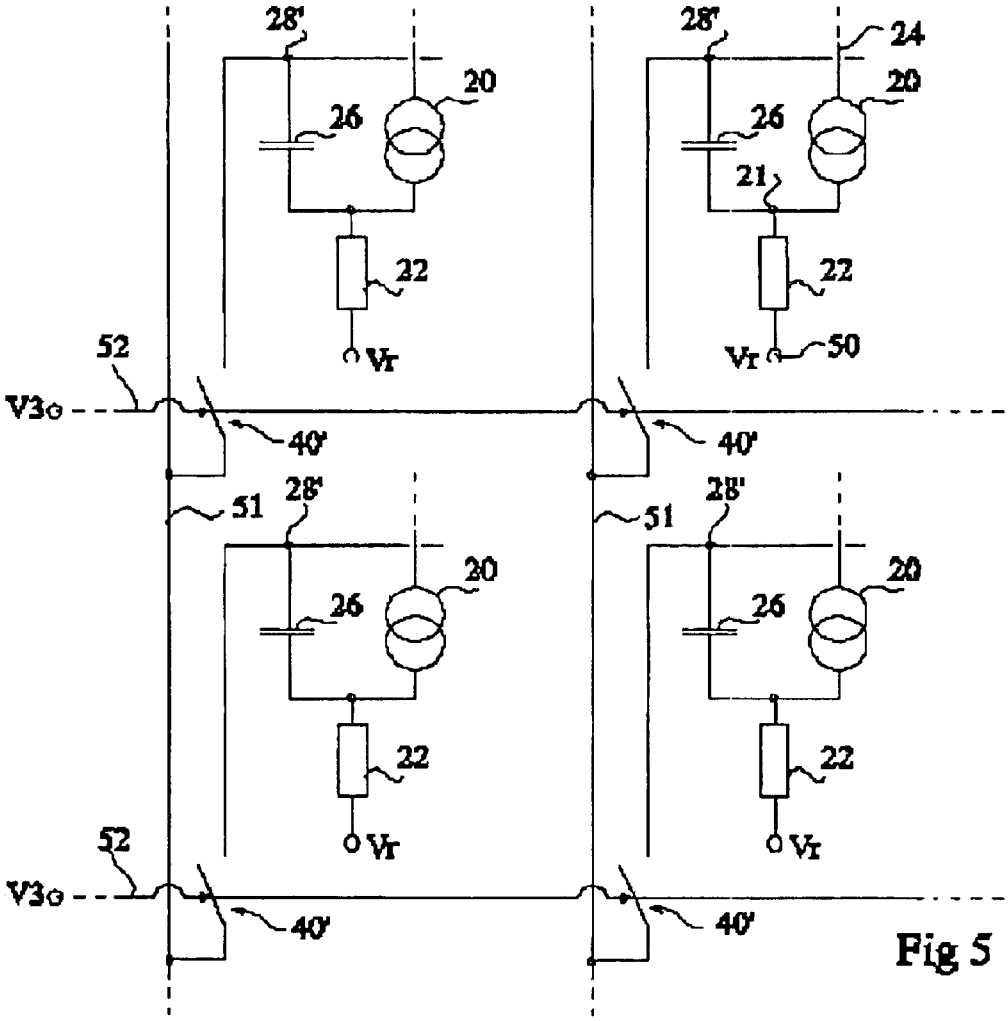
FIG. 5 is an equivalent electric diagram of a group of pixels of an embodiment of the present invention illustrating the addressing of these pixels.

FIG. 5 shows the equivalent electric diagram of a second preferred embodiment of the present invention. The representation of FIG. 5 illustrates four screen pixels to better show the conductors common to these pixels. As previously, each pixel includes a current source 20 corresponding to the microtips having their respective tips 24 directed towards the anode (not shown). The base of the microtips forms a terminal 21 of the current source connected, via resistor 22, to a reference voltage terminal 50 adapted to the present invention, which will be described hereafter. The luminance information remains provided by the cathode columns, but it is individualized at the level of the grid of the considered pixel, which includes localized so-called "pixelized" grid regions.

According to the preferred embodiment of FIG. 5, the terminal of capacitor 26, which faces terminal 21, is directly connected to a region 28' of the so-called "pixelized" grid and, via a switch 40', to a conductor 51 of the screen cathode. The switches 40' aligned in a direction perpendicular to conductors 51 are simultaneously controlled by having their respective control terminals connected to a line 52 of the grid.

However, according to the present invention, the cathode conductor 51 used to convey the luminance control signal is dissociated from conductors 50 organized in meshes and biasing the microtip base. Conductors 51 are arranged in columns and are interposed between two columns 50 of reference meshed conductors.

According to the present invention, all terminals 50 of resistors 22 are permanently biased to a reference voltage adapted to enabling electron emission when the pixel is addressed.

Thus, when a switch 40', of a pixel is closed, the grid (individualized region 28') of this pixel is brought to a control voltage corresponding to a desired brightness imposed on column conductors 51 while the base of the microtips of this pixel is at a fixed voltage. At the end of the addressing line time of conductor 52, switch 40' is opened, so that one of the terminals of capacitor 26 is in the air. The charge maintained across this capacitor (that is, the grid voltage maintained on the considered pixel) maintains the electron emission by the microtip since the voltage of terminal 50 is fixed.

It is thus possible to address the next conductor 52 and apply different control signals to conductors 51 for the next line. It should be noted that the emission current is provided by terminal 50 at the fixed voltage, so that the luminance control signal is not affected by the emission.

Preferably, at the end of a frame (or of a color sub-frame), all conductors 52 are simultaneously biased to a state where they turn on all switches 40'. During this time, all conductors 51 are addressed to ground, to discharge, during the frame flyback period, all capacitors 26 of the screen pixels and place said screen back to an initial state for the next frame.

The implementation of the present invention requires associating, with each pixel (or sub-pixel), a switch and a storage element. On this regard, the present invention takes advantage of the fact that the cathode-grid plate is formed based on techniques derived from integrated circuit manufacturing to use thin layer manufacturing methods to form the switches. Said switches are, preferably, manufactured in the form of field-effect transistors (MOS). The storage element (capacitor 26) associated with each pixel is formed by means of the insulating layer separating the cathode from the grid.

It has already been provided, for example, in U.S. Pat. No. 5,814,924, to integrate transistors in the screen cathode-grid, to enable addressing of a screen, the tips of which are not arranged in columns.

It should be noted that, although it requires additional components individualized per pixel, the present invention does not increase the surface bulk of a screen pixel. Indeed, since the present invention considerably improves the emission capacity of each pixel by allowing emission during the entire frame time, the pixel emission surface area can be reduced for a given lighting. Accordingly, the switch and the capacitor can be housed in the surface area thus spared.

Figure 3A:
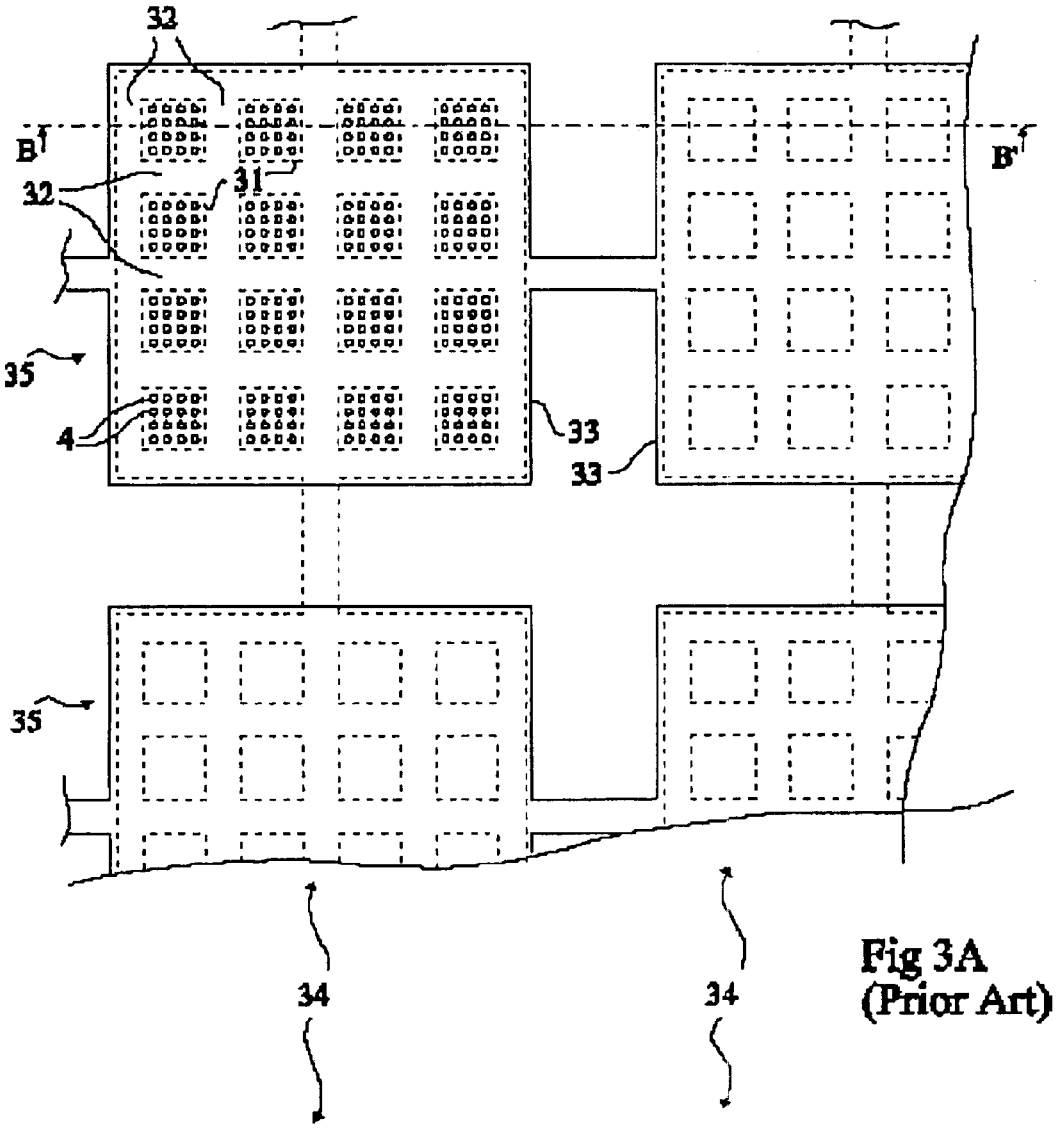
Fig 3A (Prior Art)
FIGS. 3A and 3B partially show, respectively in a top view and in a cross-section view along line B–B' of FIG. 3A, a conventional example of a cathode-grid plate of a microtip screen.
Figure 3B:
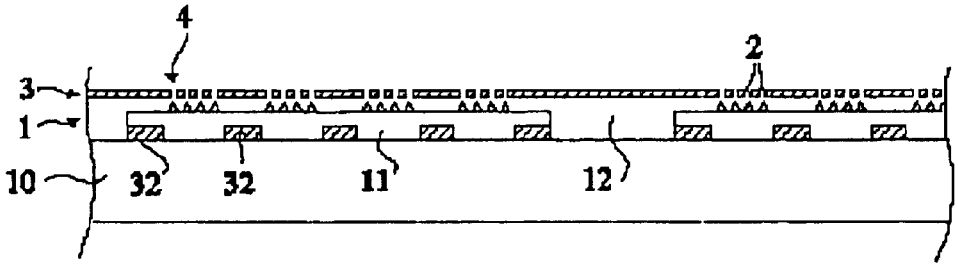
Fig 3B (Prior Art)
Figure 4:
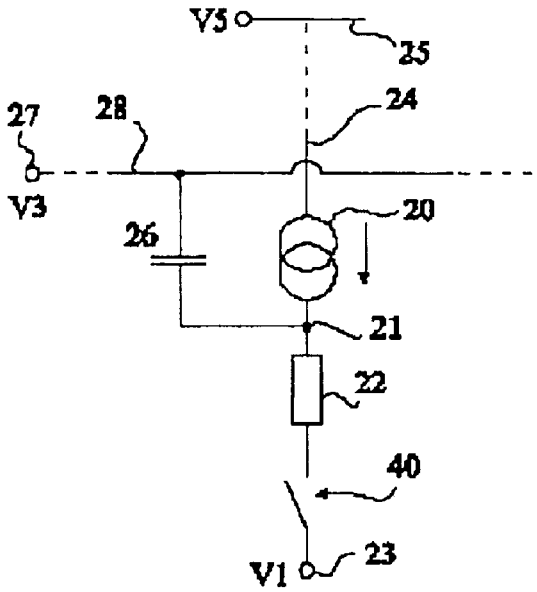
Fig 4 (Prior Art)
FIG. 4 shows an equivalent electric diagram of an embodiment of a pixel of a microtip screen provided with a temporary storing element.
Figure 6A:
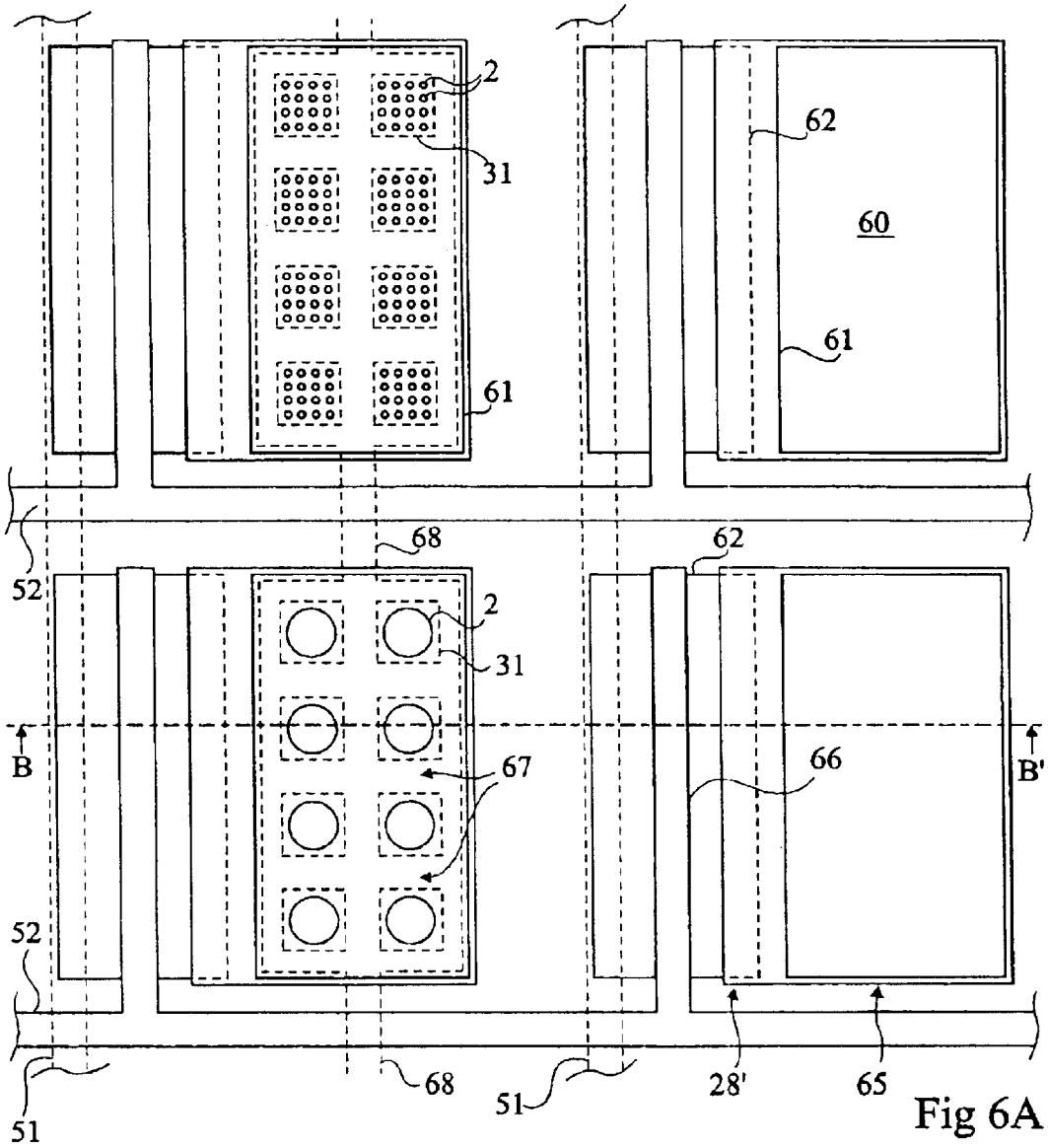
FIGS. 6A and 6B partially show, respectively in a top view and in a cross-section view along line B–B' of FIG. 6A, an embodiment of a cathode-grid plate according to the present invention.
Figure 6B:
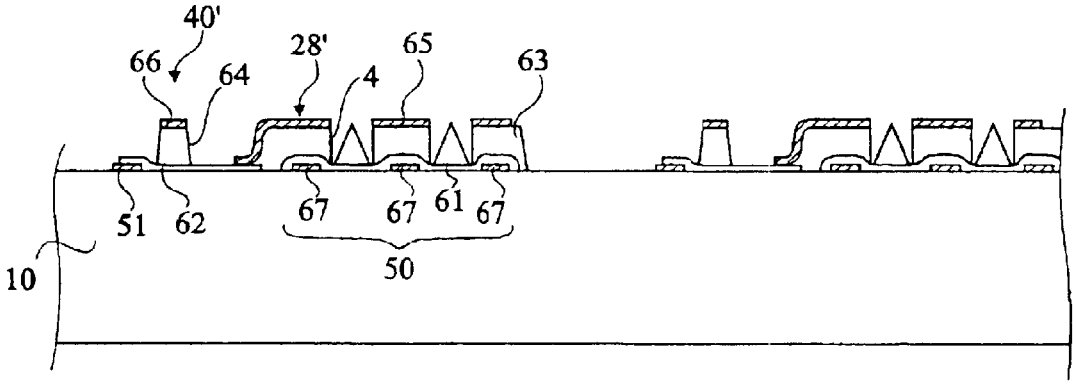

FIGS. 6A and 6B show, respectively in a top view and in a cross-section view along line B–B', of FIG. 6A, an example of forming of a cathode-grid plate implementing the present invention. To make the comparison between the representation of FIGS. 6A and 6B of the present invention and the conventional representation of FIGS. 3A and 3B easier, FIG. 6A has been set out in the same orientation as FIG. 3A, that is, the conductors (51) formed in the cathode conductive level are vertical while the conductors (52) formed in the grid conductive level are horizontal.

As illustrated in FIG. 6B, a conductive layer (for example, niobium) in which not only parallel conductive tracks 51, but also a meshing 67 for forming conductors 50 for biasing the bases of microtips 2 are formed, is first deposited on a substrate 10 (for example, glass). To make the representation of the cross-section view of FIG. 6B easier, the number of microtips 2 per screen pixel has been arbitrarily reduced to eight, assuming the presence of a single microtip per mesh 31 (FIG. 6A). Of course, the pattern of meshes 31 may follow the conventional pattern (FIG. 3A), except for the fact that the surface area occupied by an emissive pixel 60 of a screen according to the present invention can now be smaller than that of a pixel of a conventional screen. The thickness of the niobium layer in which conductors 50 and 51 are formed is, for example, on the order of 2,000 Å.

A semiconductor layer (for example, amorphous silicon) is then deposited. This layer aims at forming, on meshing 67 of conductors 50, resistive pads 61 approximately having the size of a pixel, as well as (channel) depletion area 62 of the transistors 40' associated with each pixel. In the preferred embodiment illustrated in FIGS. 6A and 6B, one of the contacts (corresponding to column 51) of the transistor is under the silicon layer constitutive of depletion area 62. The other contact of the transistor is formed, on this depletion area, in a metal used to form pixel grid region 28'. As an alternative, pads 61 and areas 62 may be made of different materials.

A layer of an insulator (for example, silicon oxide $SiO_2$) is then deposited and etched according to the pattern, for each pixel, of an area 63 separating the cathode from the grid of emission area 28' of the pixel, and of an area 64 intended for forming the gate oxide of transistors 40'.

A conductive layer (grid layer 3) is then deposited according to the pattern where it covers insulator areas 63 and 64. This conductive layer (for example, niobium with a 4,000-Å thickness), forms grid 65 above the emissive region of the pixel (region 28', FIG. 5) as well as gate 66 of transistor 40' of this pixel. The deposition of this conductive layer forms a step between the emission area and the transistor, to contact depletion area 62 of the transistor. This amounts to connecting one of electrodes 28' of the capacitor 26 formed by insulating area 63, its other electrode being formed by conductive meshing 67.

It should be noted that, outside of the surface of each pixel, the gates 66 of the different transistors 40' are interconnected in the line direction in FIG. 6A by conductors 52. Similarly, in the column direction in FIG. 6A, conductors 51 extend over the entire screen surface and meshings 67 are inter-connected by connection sections 68. This enables connecting all columns to one of the screen ends without having to provide an additional interconnection level.

It should also be noted that, as they are preferentially formed of depletion transistors, switches 40' of a screen according to the present invention are in a normally-on state. Therefore, it is necessary to bias them to a more negative voltage than the minimum addressing voltage of conductors 51, to block them outside the line times intended for them.

Taking the preceding example of operating voltages of the microtip screen, reference voltage Vr of the microtip bases (conductors 50) is −40 V. The addressing voltage of conductors 51 then ranges between 0 V (black) and +40 V (white) according to the desired pixel brightness. With this choice of voltages, (selection) grid conductors 52 are addressed, in a line scanning, that is, during a "line time", with a voltage V1 of 0 V, the quiescent voltage of the unadressed lines 52 being, for example, −40 V or less, for switch 40' to be off.

Figure 7:
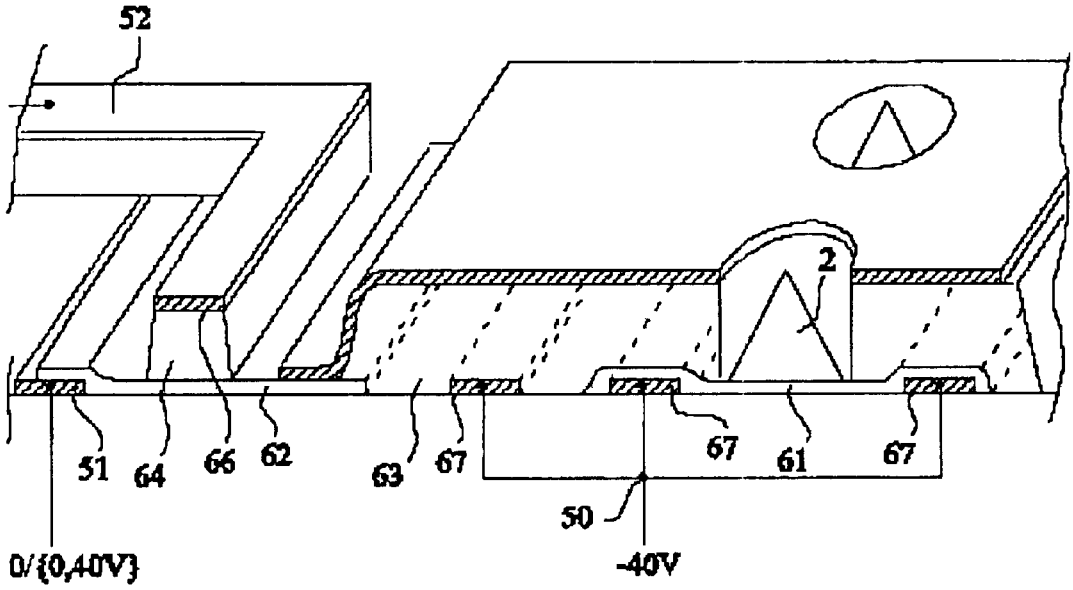
FIG. 7 is a partial perspective cross-section view of an alternative embodiment of a cathode-grid plate according to the present invention.

FIG. 7 shows, in a partial perspective cross-section view, an alternative embodiment of a cathode-grid pixel according to the present invention. According to this alternative, a specific contact 70 is provided for the electrode of capacitor 26 intended to be connected to terminal 50 of interconnection of microtip base biasing resistors 22. In this case, insulating area 63 is wider, since it is necessary to provide an additional conductive section in meshing 67 with respect to the embodiment of FIG. 6B. The choice between the embodiment of FIGS. 6B and 7 will depend, in particular, on the capacitance desired for capacitors 26 forming the elements of storage of the luminance control signals.

FIG. 7 also illustrates an alternative in which the thickness of insulating layer 12 used to form gate oxide 64 and capacitor 26 differs in the two areas 63 and 64 to individualize the sizing of the gate oxide and of the capacitor.

The respective sizing of capacitor 26 and of transistor 40' of each screen pixel will depend, in particular, on the need for storage as concerns the capacitor, and on the control voltages as concerns the transistor. This sizing will be within the abilities of those skilled in the art according to the characteristics desired for the screen operation, to the surface area of the pixels, and to the involved voltage levels. Further, the frame duration of the screen in operation will of course be taken into account. This duration determines, according to the present invention, the time constant desired for the RC cell of the pixel formed by its storage element (capacitor 26) and its microtip base biasing resistor (resistor 22).

It should be noted that the present invention is perfectly compatible with current flat display screen manufacturing methods. In particular, the implementation of the present invention requires no increase in the screen pixel surface area and is campatible with currently-used pixel widths, in particular, in the case of color screens providing one cathode column per color, which is the most constraining case in terms of column width.

It should also be noted that the implementation of the present invention requires, as compared to a current manufacturing method, no additional deposition step. If necessary, a mere additional mask will be provided to etch insulating layer 12 enabling formation of the transistor gates, and which is currently only etched to form the microtip holes (4). This is an advantage of providing a depletion transistor to control the pixel operation. Indeed, when the voltage increases on the gate of this transistor, the electrons only pass under this line in the amorphous silicon forming its depletion area.

Of course, the present invention is likely to have various alterations, modifications, and improvements which will readily occur to those skilled in the art. In particular, in the case where an additional deposition step is not disturbing, the forming of individualized switches for each pixel in the form of normally-off transistors may be provided. Further, the lighting gain brought by the implementation of the present invention may be taken advantage of in different ways. For example, advantage may be taken of it to have the screen operate under lower voltages by decreasing the number of microtips. The maximum emission voltage of the pixels may also be decreased. A decrease in the number of tips used to decrease the surface of each pixel may further be provided, to thus improve the screen resolution. To form the transistors, a significant gate width and a small gate length will preferably be provided to reduce the charge and discharge times of the respective pixel capacitors.

Such alterations, modifications, and improvements are intended to be part of this disclosure, and are intended to be within the spirit and the scope of the present invention.

Accordingly, the foregoing description is by way of example only and is not intended to be limiting. The present invention is limited only as defined in the following claims and the equivalents thereto.

What is claimed is:

1. A cathode-grid plate of a flat display screen, a cathode of which is formed of regions of electron emission microtips (2) having bases biased by cathode column conductors, a row-connected extraction grid (3) being formed of emissive areas (28') individualized per pixel and provided with holes (4) at microtip locations, an intersection of a column and a row defining a location of a screen pixel, and including, for each screen pixel, a transistor for isolating an element (26) which temporarily stores a luminance control signal of a selected pixel, a control gate oxide (64) of each transistor being formed in an insulating layer separating the cathode conductors from the row-connected extraction grid formed of the emissive areas wherein the conductors being formed of meshing for biasing the bases of the microtips.

2. The cathode-grid plate of claim 1, wherein each transistor (40') comprises a depletion area including a first contact in a same conductive level as the microtip biasing conductors (50), and a second contact in a conductive level in which are formed the emissive areas (28').

3. The cathode-grid plate of claim 2, wherein the depletion area (62) of each transistor is formed in a semiconductor level constitutive of a resistive layer (61) for biasing the microtips (2).

4. The cathode-grid plate of claim 1, wherein the microtips are connected to a fixed voltage, the luminance control signal being applied to the extraction grid.

5. A flat display screen of the type including a cathode-grid plate, a cathode of which is formed of regions of electron emission microtips (2) for bombarding a cathodoluminescent anode, the microtips (2) having bases biased by cathode column conductors, a row-connected extraction grid (3) being formed of emissive areas (28') individualized per pixel and provided with holes (4) at microtip locations, an intersection of a column and a row defining a location of a screen pixel, and including, for each screen pixel, a transistor for isolating an element (26) which temporarily stores a luminance control signal of a selected pixel, a control gate oxide (64) of each transistor being formed in an insulating layer separating the cathode conductors from the row-connected extraction grid formed of the emissive areas, wherein the conductors being formed of meshing for biasing the bases of the microtips.

6. The screen of claim 5, wherein capacitance of the storage elements (26) associated with each pixel is a function of a number of screen lines and of a voltage between an anode and the cathode.

7. A method for controlling a flat display screen comprising the steps of:

providing a flat display screen including a cathode-grid plate, a cathode of which is formed of regions of electron emission microtips (2) for bombarding a cathodoluminescent anode, the microtips (2) having bases biased by cathode column conductors, a row-connected extraction grid (3) being formed of emissive areas (28') individualized per pixel and provided with holes (4) at microtip locations, an intersection of a column and a row defining a location of a screen pixel, and including, for each screen pixel, a transistor for isolating an element (26) which temporarily stores a luminance control signal of a selected pixel, a control gate oxide (64) of each transistor being formed in an insulating layer separating the cathode conductors from the row-connected extraction grid formed of the emissive areas; and performing a line scanning for successively biasing row conductors and, for each row, applying a luminance control signal on each column conductor, wherein the conductors being formed of meshing for biasing the bases of the microtips.

8. The control method of claim 7, further comprising a step of discharging all storage elements (26) of the screen between two display frames.

* * * * *